US008511393B2

(12) United States Patent
Nguyen

(10) Patent No.: US 8,511,393 B2
(45) Date of Patent: Aug. 20, 2013

(54) SLIP HANGER ASSEMBLY AND ACTUATOR

(75) Inventor: Dennis P. Nguyen, Pearland, TX (US)

(73) Assignee: Cameron International Corporation, Houston, TX (US)

( * ) Notice: Subject to any disclaimer, the term of this patent is extended or adjusted under 35 U.S.C. 154(b) by 326 days.

(21) Appl. No.: 12/866,053

(22) PCT Filed: Mar. 4, 2009

(86) PCT No.: PCT/US2009/035999

§ 371 (c)(1),
(2), (4) Date: Aug. 4, 2010

(87) PCT Pub. No.: WO2009/111544

PCT Pub. Date: Sep. 11, 2009

(65) Prior Publication Data

US 2011/0030974 A1 Feb. 10, 2011

Related U.S. Application Data

(60) Provisional application No. 61/033,939, filed on Mar. 5, 2008.

(51) Int. Cl.

| | |
|---|---|
| ***E21B 23/00*** | (2006.01) |
| ***E21B 19/10*** | (2006.01) |
| ***E21B 23/06*** | (2006.01) |
| ***E21B 33/04*** | (2006.01) |

(52) U.S. Cl.
CPC ..... *E21B 33/04* (2013.01); *E21B 33/0422* (2013.01)
USPC ..... 166/382; 166/88.3; 166/75.14

(58) Field of Classification Search
USPC ..... 166/382, 88.3, 75.14, 379, 88.2
See application file for complete search history.

(56) References Cited

U.S. PATENT DOCUMENTS

| | | | | |
|---|---|---|---|---|
| 4,353,420 | A | 10/1982 | Miller | |
| 4,597,448 | A * | 7/1986 | Baugh | 166/348 |
| 4,886,121 | A * | 12/1989 | Demny et al. | 166/382 |
| 5,163,514 | A | 11/1992 | Jennings | |
| 6,223,819 | B1 | 5/2001 | Heinonen | |

OTHER PUBLICATIONS

PCT/US2009/035999 International Search Report and Written Opinion, Sep. 16, 2009 (11 p.).

* cited by examiner

*Primary Examiner* — Cathleen Hutchins
(74) *Attorney, Agent, or Firm* — Chamberlain Hrdlicka

(57) ABSTRACT

A slip hanger assembly for installation of casing in a wellhead, the assembly including a slip ring capable of restraining the casing in the wellhead. The assembly including a seal assembly with an inner and outer seal. The assembly also includes a hanger assembly actuator including a load ring flange, a BOP adapter including a horizontal torque provider and the BOP adapter being connectable to the wellhead, and a seal assembly actuator. The hanger assembly actuator can set the inner and outer seals independently of each other.

20 Claims, 6 Drawing Sheets

SLIP HANGER ASSEMBLY AND ACTUATOR

CROSS-REFERENCE TO RELATED APPLICATIONS

This application is a 35 U.S.C. §371 national stage application of PCT/US2009/035999 filed 4 Mar. 2009, which claims the benefit of U.S. Provisional Patent Application No. 61/033,939 filed 5 Mar. 2008, both of which are incorporated herein by reference in their entireties for all purposes.

STATEMENT REGARDING FEDERALLY-SPONSORED RESEARCH OR DEVELOPMENT

No applicable.

BACKGROUND

Wellheads are used in oil and gas drilling to suspend casing strings, seal the annulus between casing strings, and provide an interface with the blowout preventer ("BOP"). The design of a wellhead is generally dependent upon the location of the wellhead and the characteristics of the well being drilled or produced.

In drilling the well, it is conventional to pass a number of concentric tubes, or casings, down the well to support the borehole and/or isolate the borehole from fluid producing zones. An outermost casing is fixed in the ground, and the inner casings are each supported from the next outer casing by casing hangers which take the form of inter-engaging internal shoulders on the outer casing and external shoulders on the inner casing. The wellhead is thus used to support a number of casing hangers that support the weight of the casing.

Typically, such casing hangers are fixed in position on each casing and positioned in the wellhead. However, a fixed position casing hanger might be unsatisfactory if the hang-off point of one casing on another may need to be adjusted. Additionally, even if using fixed position bowl-type casing hangers, a casing may become stuck as it is being run in the well and thus the fixed casing hanger is not in position to support the casing string. In such cases, slip-type supports may be used to support the casing instead of the fixed position casing hanger.

Slip supports are friction wedges that "grip" the casing string and use "teeth" to bite into the casing when subjected to actuating force. Seal assemblies may then be used to seal the annulus between the casing and the wellhead. However, the seals as well as the casing itself are subject to forces throughout the life of the well that might cause the slip hanger to unseat. Any resulting travel of the casing or the seal assembly may compromise the seal between the casing and the wellhead. Thus, the slips and the seals used with slip-type casing hangers must be restrained from movement when subjected to force. As such the seal assemblies typically include robust bodies including both inner and out seals that are set upon actuation torque from a tool above the seal assembly. However, because the torque is applied from above the seal assembly, the actuator tool may only access one portion of the seal assembly for the actuation torque. Thus, usually both the inner and outer seals of the seal assembly are set simultaneously. In some situations, however, the inner and outer seals require different amounts of force to be set and thus simultaneous actuation constrains the ability to properly form a seal against the wellhead.

BRIEF DESCRIPTION OF THE DRAWINGS

For a more detailed description of the embodiments, reference will now be made to the following accompanying drawings.

DETAILED DESCRIPTION OF THE EMBODIMENTS

Figure 1:
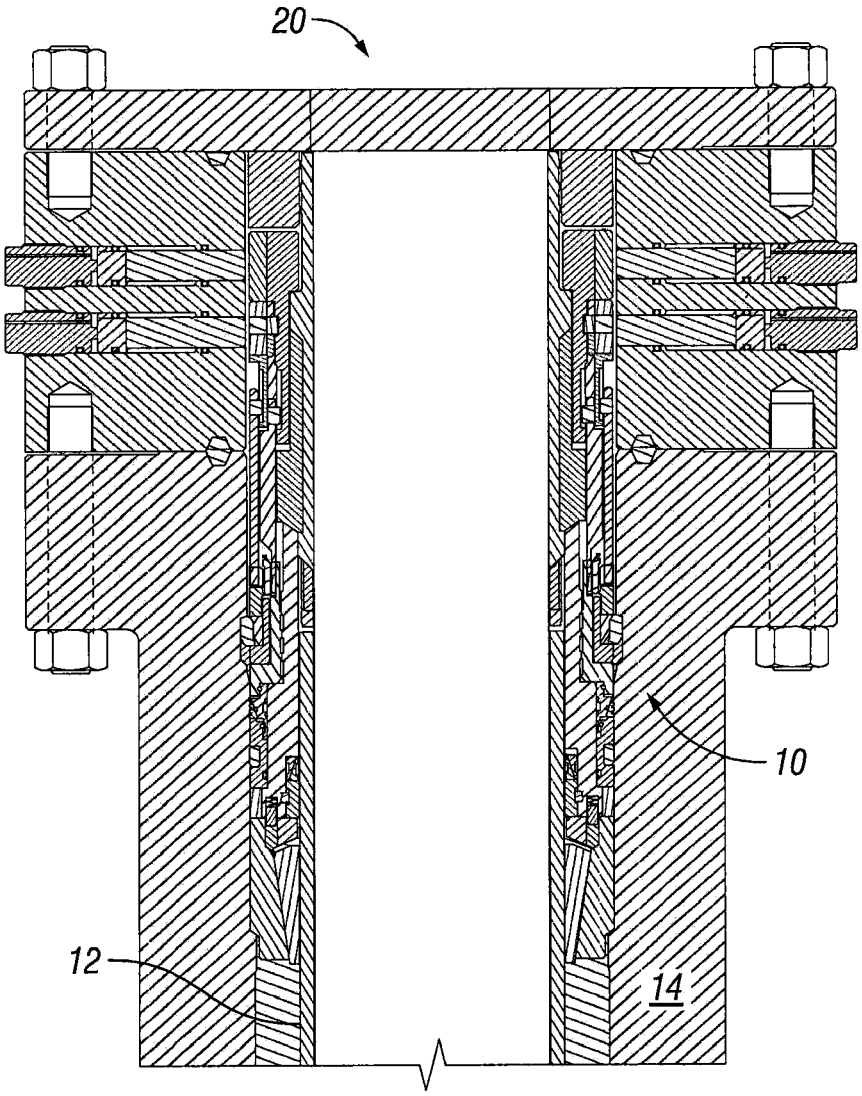
FIG. 1 is a cross section of casing in a wellhead with a slip hanger and seal assembly using an actuator of the claimed subject matter.

In the drawings and description that follows, like parts are marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness. The present invention is susceptible to embodiments of different forms. Specific embodiments are described in detail and are shown in the drawings, with the understanding that the present disclosure is to be considered an exemplification of the principles of the invention, and is not intended to limit the invention to that illustrated and described herein. It is to be fully recognized that the different teachings of the embodiments discussed below may be employed separately or in any suitable combination to produce desired results. Any use of any form of the terms "connect", "engage," "couple," "attach," or any other term describing an interaction between elements is not meant to limit the interaction to direct interaction between the elements and may also include indirect interaction between the elements described. The various characteristics mentioned above, as well as other features and characteristics described in more detail below, will be readily apparent to those skilled in the art upon reading the following detailed description of the embodiments, and by referring to the accompanying drawings.

FIG. 1 shows a slip hanger assembly 10 used to install a casing string 12 in a wellhead 14 that includes a wellhead bore. The slip hanger assembly 10 includes a slip ring 16 and a seal assembly 18 that may be used to provide a metal-to-metal seal between the casing string 12 and the wellhead 14. It will be appreciated though that seals other than a metal-to-metal seal may also be used under appropriate conditions. FIG. 1 also shows a hanger assembly actuator 20 used to set the seal assembly 18. Both the hanger assembly 10 and the hanger assembly actuator 20 will be described more fully below.

Typically a well is drilled by passing drill string though a wellhead and attached BOP. The end of the drill string includes a drill bit attached for creating the wellbore. As the wellbore is extended deeper, from time to time the borehole must be supported from collapse or must be isolated from a fluid producing formation. The drill string and drill bit are typically removed and the tubular casing string may be run into the well to the desired depth. The weight of the casing is supported by a fixed position casing hanger attached at the upper end of the casing string that is installed in the wellhead. Sometimes, however, the casing string may become stuck in the wellbore before reaching its target depth. In such condition, the casing string is typically extending out of both the wellhead and the BOP attached above.

Figure 2:
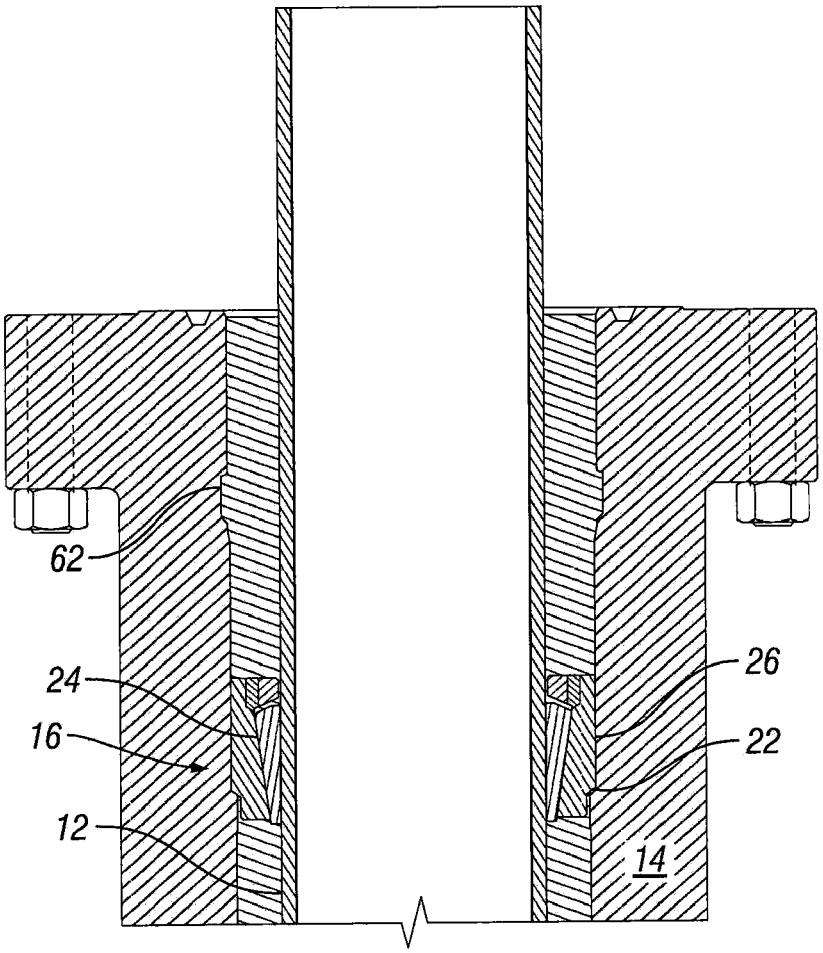
FIG. 2 is a cross section of casing in the wellhead without the seal assembly.

When the casing string 12 is stuck, as shown in FIG. 2 the connectors holding the BOP to the wellhead 14 are released and the BOP is raised along the casing string 12 until there is enough room to insert a multi-section slip ring 16 into the wellhead 14. The slip ring 16 may be multiple separate sections or may be sections connected using a hinge arrangement. The slip ring wraps around the casing string 12 and is then lowered and landed on an internal surface 22 of the wellhead bore. As shown, the slip ring 16 further includes an internal slip 24 placed within a slip bowl 26. The slip 24 includes "teeth" on its inner bore surface that are used to grip the casing string 12. The slip 24 and slip bowl 26 also include corresponding angled surfaces that cause the slip 24 to compress as it moves in a downhole direction relative to the slip bowl 26. Thus, force acting on the teeth to pull the slip 24 in the downhole direction causes the slip 24 to grip the casing 12 due to the angle of the corresponding slip and slip bowl surfaces. Although the casing 12 is in a stuck position, the slip ring 16 will prevent any further movement of the casing in the downhole direction.

With the slip ring 16 landed in the wellhead 14 and the BOP raised, a preliminary cut of the casing 12 is made below the BOP and the BOP and cut off casing are removed as shown in FIG. 2. The preliminary cut of the casing 12 allows access to the wellhead 14 above the slip ring 16 to determine the proper configuration for the seal assembly 18 to lock into a seal assembly groove 62 on the interior surface of the wellhead bore and leave enough casing 12 in the wellhead to properly form a seal.

Figure 3:
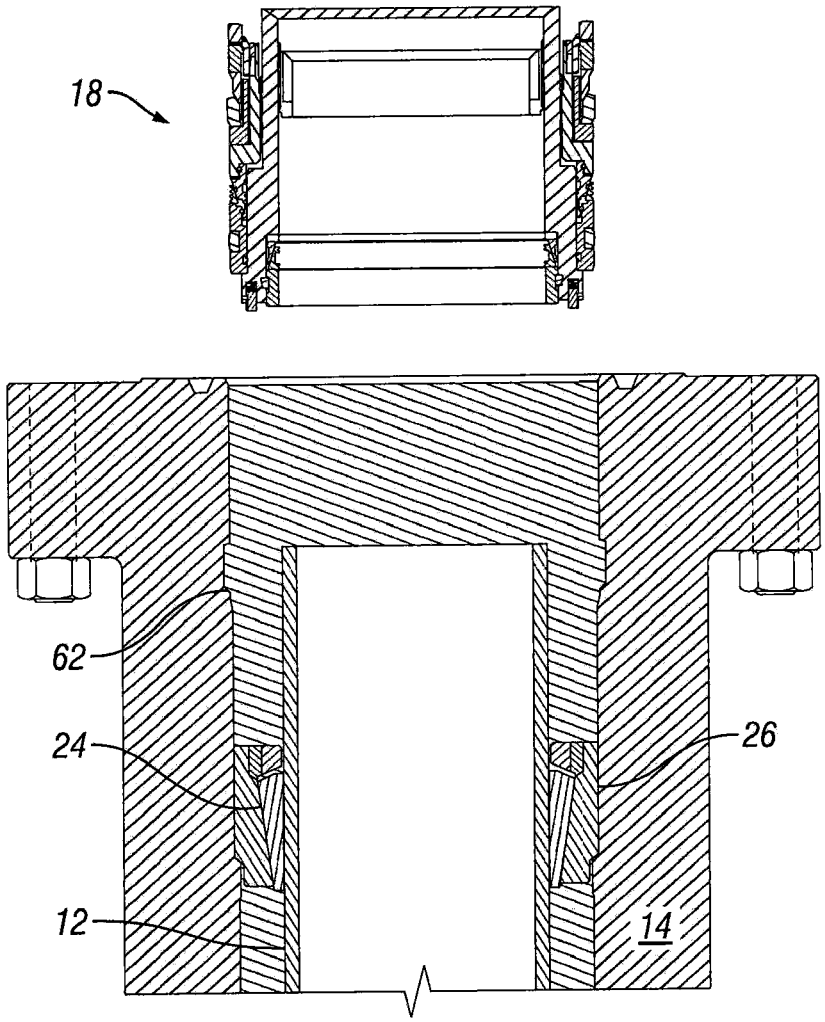
FIG. 3 is a cross section of casing in the wellhead showing an uninstalled seal assembly positioned outside the wellhead.
Figure 5:
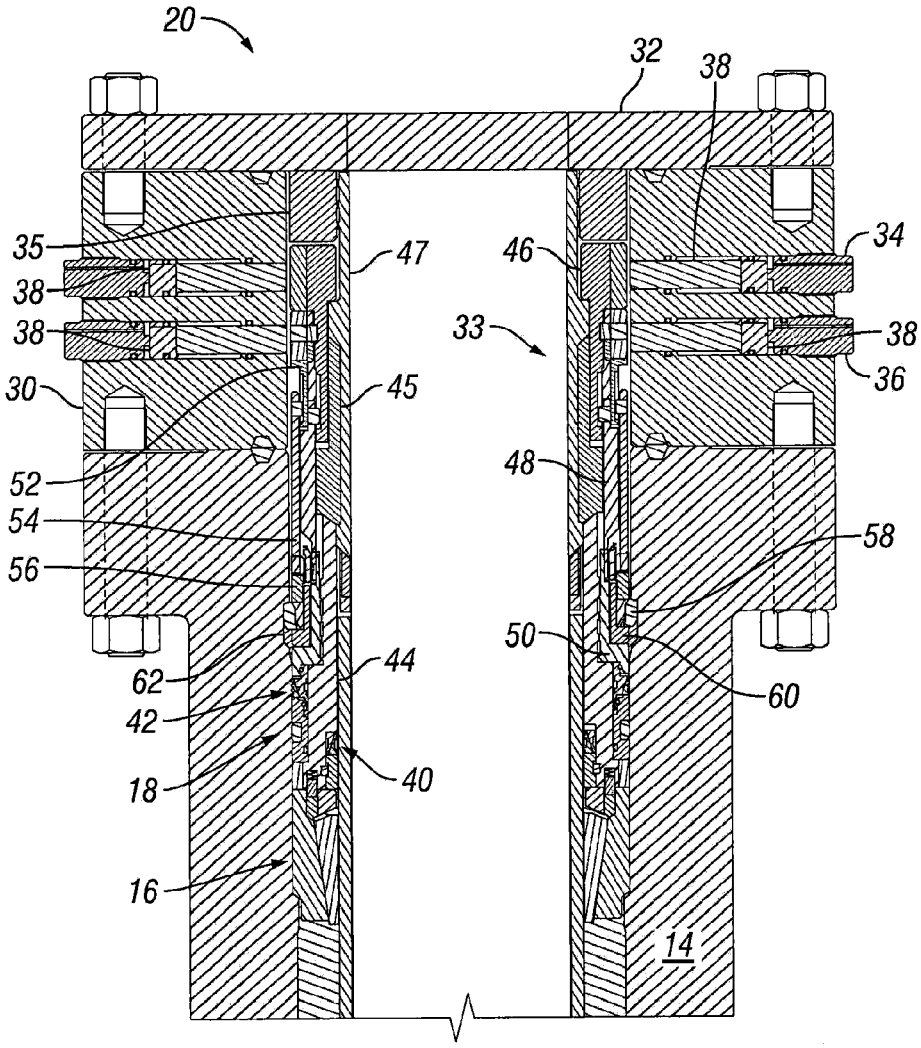
FIG. 5 is a cross section of the casing installed with the slip hanger and seal assembly with the actuator engaged with the wellhead.

With the measurements taken and the seal assembly 18 configured, an internal cutter is used to make a final cut of the casing 12 as shown in FIG. 3. The seal assembly 18 is then inserted above the slip ring 16 from above the wellhead 14 and landed on the slip ring 16 as shown in FIG. 5. As previously noted, the seal assembly 18 forms a metal-to-metal seal between the casing 12 and the wellhead 14 but it is also appreciated that a nonmetal seal may also be used when appropriate.

Figure 4:
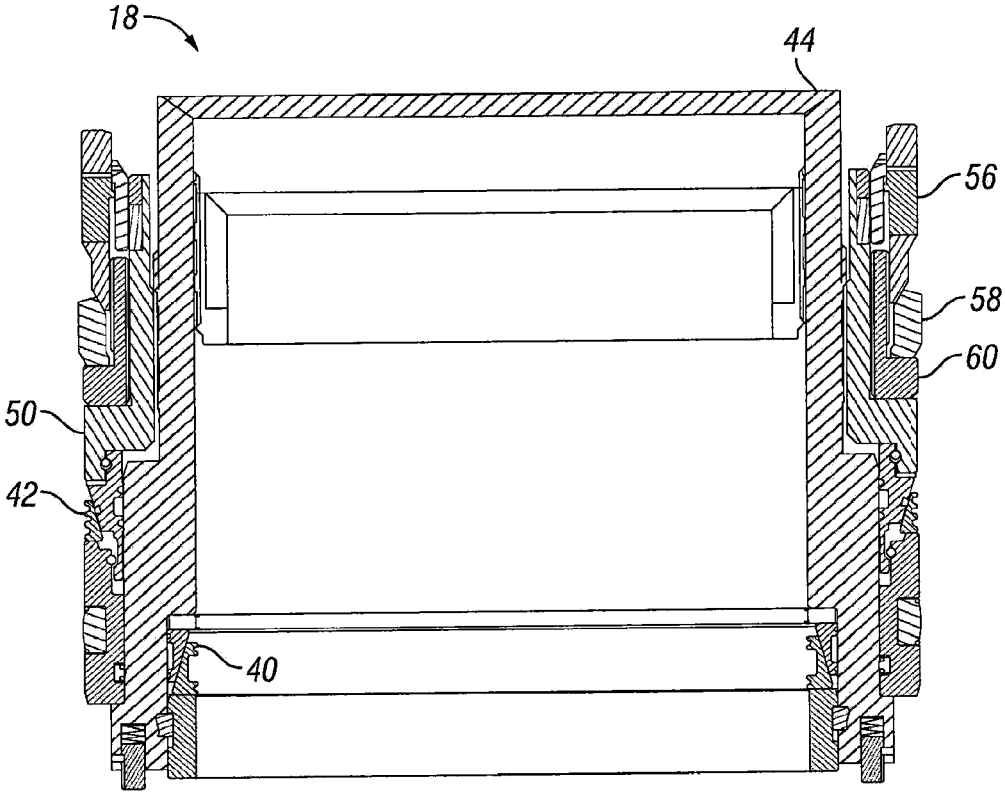
FIG. 4 is a cross section of the seal assembly.

Referring to FIGS. 4 and 5, with the seal assembly in place, the hanger assembly actuator 20 is installed on the wellhead 14. The hanger actuator assembly 20 includes a BOP adapter 30, and load ring flange 32, and a seal assembly actuator 33 that are installed onto the wellhead. Connectors such as threads are then tightened to secure the BOP adapter 30 and the load ring flange 32 to the wellhead 14.

As shown in FIG. 5, the BOP adapter 30 provides torque in a direction perpendicular to the longitudinal axis of the casing string 12. As shown in FIG. 5, the BOP adapter 30 becomes essentially a horizontal torque provider that provides torque to actuate and set the seal assembly 18. Thus, unlike some prior systems that require vertical access to the seal assembly, the slip hanger assembly 10 allows "horizontal" access to the seal assembly 18. The BOP adapter 30 may thus provide torque to the seal assembly 18 in different locations, in different amounts, and at different times if desired, which would not be possible with typical previous "vertical" access torque providers.

In the example shown in FIG. 5, the BOP adapter 30 includes two torque providers, a first, or "upper," torque provider 34 and a second, or "lower," torque provider 36. It is appreciated that upper and lower torque providers 34 and 36 may be any suitable configuration for providing torque to the seal assembly 18. For example, as shown the torque providers 34, 36 are hydraulically powered to actuate pistons 38 and produce a rotational force on the seal assembly 18. However, torque may be provided by other means, even including providing torque manually. Also, although shown with two torque providers 34, 36, the BOP adapter 30 may include any number of torque providers depending on the design of the seal assembly 18.

As shown in FIGS. 4 and 5, the seal assembly 18 is designed to form a seal in the annulus between the casing string 12 and the wellhead 14. To do so, the seal assembly 18 includes two seals, an inner seal 40 that seals between the seal assembly 18 and the casing string 12 and an outer seal 42 that seals between the seal assembly 18 and the wellhead 14. The seal assembly 18 is also designed such that the inner seal 40 and the outer seal 42 may be set independently. Although typically set at different times, the inner seal 40 and the outer seal 42 may also be set contemporaneously. However, the inner seal 40 is typically set before the outer seal 42. Both the inner seal 40 and the outer seal 42 include slip type seals that actuate with axial compression, similar to the slip ring 16. Thus, as the inner and outer seals 40, 42 are compressed, they expand radially to form a seal. It is appreciated though that the described seals 40, 42 are examples and that their specific configuration may vary from that shown and described.

The seal assembly 18 includes nested sleeves, or rings, one if which is an inner force ring 44 that is used to set the inner seal 40. Additionally, the seal assembly actuator 33 includes an inner support ring 45 that aligns with the force ring 44 and that is supported by a stud 47. An adjustable ring 35 is then threaded onto the upper end of the stud 47. The force ring 44 is supported by the slip ring 16 and is designed such that as the BOP adapter 30 and the load ring flange 32 are secured, the adjustable ring 35, the stud 47, and the inner support ring 45 force the inner force ring 40 toward the slip ring 16, compressing the inner seal 40. The amount of force applied may vary depending on the application and relates to the spacing between the load ring flange 32 and the inner force ring 44. To account for different configurations and tolerances, the adjustable ring 35 may be positioned axially by rotation relative to the stud 47 to affect the amount of force transferred to the inner force ring 44 and thus the amount of compression of the inner seal 40. When compressed, the inner seal 40 expands the inner seal 40 radially to set the seal between the casing string 12 and the seal assembly 18. The force from the BOP adapter 30 and the load ring flange 32 also restrains the inner force ring 44 from rotating during the setting procedure as explained further below.

Though the inner seal 40 is set using compressive force, the outer seal 42 is set by torque from the torque providers 34, 36. Again as shown in FIGS. 4 and 5, the seal assembly actuator 33 also includes an upper torque ring 46 and an inner torque ring 48. The upper torque ring 46 is supported for rotation within the seal assembly 18 but does not move axially. As shown, the upper torque provider 34 engages the upper torque ring 46 to provide torque for rotation. The upper torque ring 46 engages the inner torque ring 48 in a tongue-in-groove arrangement such that rotating the upper torque ring 46 rotates the inner torque ring 48 while allowing the inner torque ring 48 to move axially. In addition, the inner torque ring 48 engages an inner energizing ring 50 of the seal assembly 18 in a tongue-and-groove arrangement such that rotation is transferred from the inner torque ring 48 to the inner energizing ring 50. The upper torque provider 34 may thus be used to rotate the inner energizing ring 50. Additionally, the inner energizing ring 50 is threaded to the inner force ring 44 with a thread turn in a first direction of either right or left hand threads. Because the inner force ring 44 is restrained, rotation of the inner energizing ring 50 moves the inner energizing ring 50 in the direction of the outer seal 42. Doing so compresses the outer seal 42, thus expanding the inner seal 42 radially to set the seal between the seal assembly 18 and the wellhead 14.

Once the outer seal 42 is set, the upper torque provider 34 may be deactivated to stop applying torque to the upper torque ring 46. The lower torque provider 36 may then be activated to lock the inner and outer seals 40, 42 as well as lock the seal assembly 18 to the wellhead 14. As shown the seal assembly actuator 33 further includes a lower torque ring 52 and an outer torque ring 54. Similarly to the upper torque provider 34, the lower torque provider 36 rotates the lower torque ring 52 that rotates without axial movement. The lower torque ring 52 is likewise similar to the upper torque ring in that it is engaged with the outer torque ring 54 in a tongue-in-groove arrangement such that rotating the lower torque ring 52 rotates the outer torque ring 54 while allowing the outer torque ring 54 to move axially. In addition, the outer torque ring 54 engages an outer energizing ring 56 of the seal assembly 18 in a tongue-and-groove arrangement such that rotation is transferred from the outer torque ring 54 to the outer energizing ring 56. The lower torque provider 36 may thus be used to rotate the outer energizing ring 56.

Additionally, the seal assembly 18 includes a lock ring 58 and a load ring 60. The load ring 60 includes outer threads such that the load ring 60 is threaded into the inner energizing ring 50 with a thread turn opposite that of the threaded connection between the inner energizing ring 50 and the inner force ring 44. For example, if the inner force ring threads are right hand turn threads, the load ring outer threads are left hand turn threads, and vice versa. The lower torque provider 36 thus may rotate the outer energizing ring to rotate the load ring 60 to move the load ring 60 toward the outer seal 42 until the load ring 60 bottoms out against a shoulder or stop on the inner energizing ring 50 and is restrained from rotation.

With the load ring 60 restrained, further rotation of the outer torque ring 54 acts on the outer energizing ring 56 to set the lock ring 58. The lock ring 58 is expandable and may either be a segmented ring, a "C" ring, or any other suitable expandable configuration. Further, the lock ring 58 is shown in a configuration for engaging a corresponding lock ring groove 62 in the wellhead 14. It should be appreciated, however, that the lock ring 58 and the lock ring groove 62 may be any suitable configuration for proper locking engagement of the seal assembly 18. The outer energizing ring 56 and the lock ring 58 also include corresponding slip type surfaces that operate to expand the lock ring 58 into engagement with the lock ring groove 62 upon relative movement. Additionally, the outer energizing ring 56 includes outer threads such that the outer energizing ring 56 is threaded into the load ring 60 with a thread turn opposite that of the load ring outer threads and the same turn as the inner energizing ring outer threads. Thus, the three sets of threads may have either a left-right-left hand turn configuration or a right-left-right hand turn configuration. Rotating the outer energizing ring 56 thus causes the outer energizing ring 56 to travel in the direction of the lock ring 58, thus expanding the lock ring 58 into the lock ring groove 62 until locked as shown in FIG. 5.

Additionally, the outer energizing ring 56, the lock ring 58, and the load ring 60 hold the inner energizing ring 50, and thus the outer seal 42 in place. As shown, the load ring 60 includes a flange with a lower surface that interacts with a shoulder on the inner energizing ring 50. The load ring 60 also includes a flange upper surface that interacts with the lock ring 58. Thus, with the load ring 60 and the lock ring 58 set, the inner energizing ring 50 is secured by the lock ring 58 engaging the lock ring groove 62 and restraining the load ring 60 from movement. Additionally, the inner energizing ring 50 includes an inner shoulder that interacts with a corresponding shoulder on the inner force ring 44 that is securing the inner seal 40. Thus, securing the inner energizing ring not only secures the outer seal 42, but also secures the inner seal 40 by securing the inner force ring 44.

Figure 6:
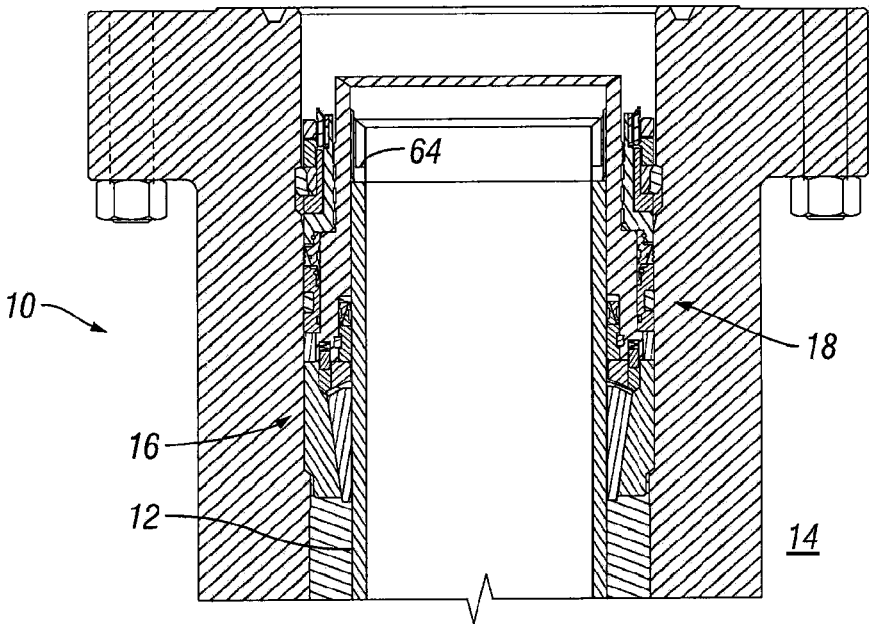
FIG. 6 is a cross section of the casing installed with the slip hanger and seal assembly with the actuator removed and a hold-down ring installed.

With the inner and outer seals 40, 42 set and the seal assembly 18 locked to the wellhead 14, the hanger assembly actuator 20 may be removed. As shown in FIG. 6, the connectors fastening the BOP adapter 30 and/or the connectors fastening the load ring flange 32 are loosened so that the load ring flange 32, the BOP adapter 30, and the seal assembly actuator 33 are removed from the wellhead 14. As explained, even though the hanger actuator assembly is removed, the lock ring 58 and the load ring 60 act to secure the inner seal 40 and the outer seal 42 as well as the seal assembly 18 itself to the wellhead 14. Although the seal assembly 18 is secured in place and the casing 12 is supported by the slip ring 16, the casing 12 may need to be secured from movement out of the well, such as from expansion due to temperature differentials. Such expansion may compromise the slip ring 16 engagement as well as the setting of the inner seal 40. As shown in FIG. 6, to prevent such issues, a hold-down ring 64 is threaded into the interior of the inner force ring 44 to restrain the casing 12 from movement out of the well. With the seal assembly 18 and the casing 12 secure, the BOP may be reinstalled on the wellhead 14 and drilling operations may continue.

While specific embodiments have been shown and described, modifications can be made by one skilled in the art without departing from the spirit or teaching of this invention. The embodiments as described are exemplary only and are not limiting. Many variations and modifications are possible and are within the scope of the invention. Accordingly, the scope of protection is not limited to the embodiments described, but is only limited by the claims that follow, the scope of which shall include all equivalents of the subject matter of the claims.

What is claimed is:

1. A slip hanger assembly for installation of casing in a wellhead, the assembly including:

a slip ring capable of restraining the casing in the wellhead;

a seal assembly including an inner and outer seal and a longitudinal axis;

a hanger assembly actuator including:

a BOP adapter including a torque provider to provide a rotational force in a plane at an angle to the longitudinal axis of the seal assembly, the BOP adapter being connectable to the wellhead; and a seal assembly actuator; and wherein the hanger assembly actuator can set the inner and outer seals independently of each other.

2. The assembly of claim 1, wherein the torque provider can impart linear force in a plane perpendicular to the longitudinal axis of the seal assembly to rotate at least a portion of the seal assembly actuator to set at least one of the inner and outer seals.

3. The assembly of claim 1, wherein the inner seal is set by compressive force from attachment of a load ring flange to the BOP adapter.

4. The assembly of claim 1, the seal assembly further including a lock assembly capable of locking the inner and outer seals in a set position and locking the seal assembly in the wellhead.

5. The assembly of claim 4, wherein:

the torque provider can impart linear force to rotate the lock assembly to set the lock assembly; and the lock assembly can be set independently of the at least one of the inner and outer seals.

6. The assembly of claim 1, the BOP adapter including more than one torque provider and the torque providers including hydraulically powered pistons to provide the linear force.

7. The assembly of claim 1, wherein:

the seal assembly includes nested sleeves locatable within the wellhead; and the seal assembly actuator includes nested sleeves locatable within the BOP adapter.

8. A casing installation system including:

a wellhead;

a casing string;

a slip ring capable of restraining the casing string in the wellhead;

a seal assembly including an inner and outer seal and a longitudinal axis;

a hanger assembly actuator including:

a BOP adapter including a torque provider to provide a rotational force in a plane at an angle to the longitudinal axis of the seal assembly, the BOP adapter being connectable to the wellhead; and a seal assembly actuator; and wherein the hanger assembly actuator can set the inner and outer seals independently of each other.

9. The system of claim 8, wherein the torque provider can impart linear force in a plane perpendicular to the longitudinal axis of the seal assembly to rotate at least a portion of the seal assembly actuator to set at least one of the inner and outer seals.

10. The system of claim 8, wherein the inner seal is set by compressive force from attachment of a load ring flange to the BOP adapter.

11. The system of claim 8, the seal assembly further including a lock assembly capable of locking the inner and outer seals in a set position and locking the seal assembly in the wellhead.

12. The system of claim 11, wherein:

the torque provider can impart linear force to rotate the lock assembly to set the lock assembly; and the lock assembly can be set independently of the at least one of the inner and outer seals.

13. The system of claim 8, the BOP adapter including more than one torque provider and the torque providers including hydraulically powered pistons to provide the linear force.

14. The system of claim 8, wherein:

the seal assembly includes nested sleeves locatable within the wellhead; and the seal assembly actuator includes nested sleeves locatable within the BOP adapter.

15. A method of installing casing in a borehole including:

installing a wellhead;

inserting the casing into the borehole through the wellhead;

inserting a slip ring into the wellhead and surrounding the casing, the slip ring capable of restraining the casing in the wellhead;

inserting a seal assembly into the wellhead surrounding the casing, the seal assembly including an inner and outer seal and a longitudinal axis;

installing a hanger assembly actuator including a seal assembly actuator, wherein the hanger assembly actuator includes a BOP comprising a torque provider, the BOP adapter being connectable to the wellhead; and setting the inner and outer seals independently of each other using the hanger assembly actuator to provide a rotational force in a plane at an angle to the longitudinal axis of the seal assembly.

16. The method of claim 15, further including imparting a linear force in a plane perpendicular to the longitudinal axis of the seal assembly to rotate at least a portion of the seal assembly actuator to set at least one of the inner and outer seals.

17. The method of claim 16, wherein imparting linear force includes actuating more than one torque provider in a BOP adapter attached to the wellhead, actuating the torque providers including hydraulically powering pistons to impart the linear force.

18. The method of claim 15, wherein installing the hanger assembly actuator includes installing a load ring flange and a BOP adapter to the wellhead and further including setting the inner seal by compressive force from installing the load ring flange and the BOP adapter.

19. The method of claim 18, wherein:

locking the inner and outer seals and the seal assembly includes imparting linear force in a plane perpendicular to the longitudinal axis of the seal assembly to rotate at least a portion of the seal assembly actuator; and the locking can be done independently of setting the at least one of the inner and outer seals.

20. The method of claim 15, further including locking the inner and outer seals in a set position and locking the seal assembly in the wellhead.

* * * * *